US009834878B2

(12) United States Patent
Egami et al.

(10) Patent No.: US 9,834,878 B2
(45) Date of Patent: Dec. 5, 2017

(54) EMBROIDERY MACHINE ABLE TO SEW CORD MATERIAL

(71) Applicant: TOKAI KOGYO MISHIN KABUSHIKI KAISHA, Kasugai-shi, Aichi-ken (JP)

(72) Inventors: Shinko Egami, Kasugai (JP); Riquan Li, Kasugai (JP); Makoto Ishizawa, Kasugai (JP)

(73) Assignee: TOKAI KOGYO MISHIN KABUSHIKI KAISHA, Kasugai-Shi (JP)

( * ) Notice: Subject to any disclaimer, the term of this patent is extended or adjusted under 35 U.S.C. 154(b) by 0 days.

(21) Appl. No.: 15/111,928

(22) PCT Filed: Mar. 25, 2015

(86) PCT No.: PCT/JP2015/059273
§ 371 (c)(1),
(2) Date: Jul. 15, 2016

(87) PCT Pub. No.: WO2015/147118
PCT Pub. Date: Oct. 1, 2015

(65) Prior Publication Data

US 2016/0348291 A1 Dec. 1, 2016

(30) Foreign Application Priority Data

Mar. 27, 2014 (JP) ..... 2014-065801

(51) Int. Cl.
*D05C 7/08* (2006.01)
*D05B 3/04* (2006.01)
(Continued)

(52) U.S. Cl.
CPC ..... *D05C 7/08* (2013.01); *D05B 3/04* (2013.01); *D05B 35/06* (2013.01); *D05B 53/00* (2013.01)

(58) Field of Classification Search
CPC ..... D05B 3/04; D05B 55/06; D05B 15/06; D05B 29/06; D05B 37/04; D05C 15/20; D05D 2303/08
See application file for complete search history.

(56) References Cited

U.S. PATENT DOCUMENTS 3,547,059 A * 12/1970 Dolney ..... D05B 3/18 112/151
4,372,230 A * 2/1983 Ciecior ..... D05B 1/20 112/139
(Continued)

FOREIGN PATENT DOCUMENTS

JP 0560477 U 8/1993
JP H05295648 A 11/1993
(Continued)

OTHER PUBLICATIONS

International Search Report issued in Intl. Appln. No. PCT/JP2015/059273 dated Jun. 16, 2015. English translation provided.

*Primary Examiner* — Tejash Patel
(74) *Attorney, Agent, or Firm* — Rossi, Kimms & McDowell LLP

(57) ABSTRACT

A needle bar case has a plurality of needle bars. As a main shaft is rotated by a main shaft motor (first drive source), the needle bars are driven in an up-down direction so that a sewing operation is carried out in a conventionally-known manner. Ascending/descending bars are supported on the needle bar case in corresponding relation to the needle bars, and each of the ascending/descending bars is driven in the up-down direction by a motor (second drive source). A cord guide member for guiding a cord material onto a workpiece
(Continued)

is mounted to the lower end of any of the ascending/descending bars, in place of a conventional presser foot. Cord sewing or loop sewing of cord material can be performed selectively by changing an ascending/descending stroke of the ascending/descending bar. Thus, cord sewing and loop sewing of the chord material can be performed selectively with a simple construction.

7 Claims, 6 Drawing Sheets

(51) Int. Cl.
*D05B 35/06* (2006.01)
*D05B 53/00* (2006.01)

(56) References Cited

U.S. PATENT DOCUMENTS

| | | | | |
|---|---|---|---|---|
| 4,637,329 | A * | 1/1987 | Czelusniak, Jr. ..... | D05C 15/20 112/80.41 |
| 2013/0152838 | A1* | 6/2013 | Matsumoto ..... | D05B 65/02 112/285 |

FOREIGN PATENT DOCUMENTS

| | | | |
|---|---|---|---|
| JP | H06257060 | A | 9/1994 |
| JP | H08226067 | A | 9/1996 |
| JP | H0931826 | A | 2/1997 |
| JP | 2004308082 | A | 11/2004 |
| JP | 2006136484 | A | 6/2006 |
| JP | 2014151005 | A | 8/2014 |

* cited by examiner

EMBROIDERY MACHINE ABLE TO SEW CORD MATERIAL

TECHNICAL FIELD

The present invention relates to an embroidery sewing machine (embroidery machine) capable of sewing a cord material onto a sewing workpiece.

BACKGROUND ART

Examples of the conventionally-known method for sewing an ornamental chord material onto a sewing workpiece include loop sewing in which the cord material is sewn onto the sewing workpiece in a loop configuration and cord sewing in which the cord material is extended above and over the sewing workpiece and sewn onto the sewing workpiece as if adhered onto and along the upper surface of the sewing workpiece. In performing the loop sewing and the cord sewing, it was heretofore necessary to attach respective dedicated guide devices. Therefore, in order to change from one of the loop sewing and the cord sewing to the other, it was necessary to attach and detach the guide devices, which resulted in poor operating efficiency. To avoid such an inconvenience, a guide device has been proposed which can be used both for the loop sewing and the cord sewing as disclosed in Patent Literature 1.

The guide device disclosed in Patent Literature 1 is constructed to be attached or mounted to an end portion of a machine head frame, and the sewing machine is constructed in such a manner that a cord material is sewn by use of one of a plurality of needle bars, provided on the machine head frame, which is located on the end portion having the guide device mounted thereto. More specifically, in the loop sewing, the guide device forms a loop of the cord material by a loop holder of the guide device moving downward or descending in response to descending of the needle bar and releases the cord material by the loop holder moving upward or ascending by a resilient force of a coil spring in response to ascending of the needle bar. A height of the loop in the loop sewing is adjustable by changing a height of an adjusting bolt screwed to the upper end of an ascending/descending shaft. Further, when the cord sewing is to be performed, the loop holder is replaced with a cord holder, and a cord presser, provided at the distal end of the cord holder, holds the cord on the sewing workpiece by the resilient force of the coil spring.

However, the guide device disclosed in Patent Literature 1 does itself have a complicated mechanical mechanism. Thus, the technique disclosed in Patent Literature 1 encounters the inconvenience that the guide device having such a complicated mechanical mechanism has to be attached to the sewing machine. Furthermore, because the guide device disclosed in Patent Literature 1 is constructed to be attached to one end portion of the machine head frame, only one needle bar located at the end portion to which the guide device is mounted can be used for the sewing of the cord material. With such a conventionally-known structure, only up to two guide devices can be mounted to the machine head frame, one to each of the left and right ends of the machine head frame, as a result of which only two types of cord materials at most can be sewn. Furthermore, when the height of the loop sewing is to be adjusted, a mechanical adjusting operation of turning the adjusting bolt is required, and thus, the loop height adjustment tends to require time and labor.

PRIOR ART LITERATURE

Patent Literature

Patent Literature 1: Japanese Patent Application Laid-open Publication No. 2004-308082

SUMMARY OF INVENTION

In view of the foregoing prior art problems, it is an object of the present invention to provide an embroidery sewing machine which, with a simple construction, can selectively perform chord sewing and loop sewing of a cord material.

An embroidery sewing machine of the present invention comprises: a needle bar having a sewing needle attached thereto; a first drive source which drives the needle bar in an up-down direction; an ascending/descending member provided in corresponding relation to the needle bar; a second drive source which drives the ascending/descending member in the up-down direction; and a cord guide member mounted to the ascending/descending member for guiding a cord material onto a sewing workpiece.

According to the present invention, the cord guide member is mounted to the ascending/descending member that is driven to move in an up-down direction (i.e., move up and down) by the second drive source separate from the first drive source that drives the needle bar. By the ascending/descending member being driven to move in the up-down direction (i.e., move up and down) by the second drive source, the cord guide member can be driven independently of the up-down movement of the needle bar. Thus, the embroidery sewing machine of the present invention can selectively perform the loop sewing and the chord sewing of the cord material by merely controlling the second drive source so as to change the ascending/descending stroke of the cord guide member. More specifically, by setting the ascending/descending stroke length of the ascending/descending member at zero, the embroidery sewing machine of the present invention can perform the "cord sewing" to sew the cord material onto the sewing workpiece as if adhering the cord material onto and along the upper surface of the sewing workpiece. By moving the ascending/descending member up and down with the ascending/descending stroke length set greater than zero, the embroidery sewing machine of the present invention can perform the "loop sewing" to sew the cord material onto the sewing workpiece in a loop configuration. In the loop sewing, the height of the loop is substantially proportional to the ascending/descending stroke length of the ascending/descending member. Thus, by merely changing the ascending/descending stroke length of the ascending/descending member, it is possible to adjust the loop height of the cord material to be sewn, without performing any mechanical adjusting operation.

In one embodiment of the invention, the embroidery sewing machine comprises a plurality of the needle bars and a plurality of the ascending/descending members corresponding to individual ones of the needle bars, and the cord guide member may be mounted to at least one of the plurality of the ascending/descending members. With the embroidery sewing machine of the invention, the cord guide members can be mounted to any desired ones of the ascending/descending members, and thus, it is possible to perform the cord sewing or the loop sewing of the cord material by use of the respective needle bars. Thus, chord materials of as many different types as the number of needle bars can be sewn.

In one embodiment of the invention, the cord guide member is detachably mounted to the ascending/descending member, and the ascending/descending member is constructed to allow one of the cord guide member and a presser foot to be detachably mounted thereto in such a manner the one of the cord guide member and the presser foot is replaceable with the other of the cord guide member and the presser foot. Thus, the embroidery sewing machine, which includes the ascending/descending-member-driving second drive source separate from the needle-bar-driving first drive source, can selectively perform the cord sewing and the loop sewing of the cord member with a simple construction where merely the cord guide member is mounted in place of an existing or conventional presser foot.

Further, in one embodiment of the invention, the cord guide member includes: a pressing section disposed beneath the needle bar corresponding to the ascending/descending member having the cord guide member mounted thereto; a lead-out hole provided in a bottom portion of the pressing section for guiding the cord material onto the sewing workpiece, the sewing needle being passed through the lead-out hole; and a lead-in hole for guiding the cord material to the lead-out hole. The cord guide member thus constructed also has functionality as the presser foot that is used in ordinary embroidery sewing.

The present invention achieves the superior advantageous benefit that it can provide an improved embroidery sewing machine which, with a simple construction, can selectively perform the chord sewing and the loop sewing of a cord material.

BRIEF DESCRIPTION OF DRAWINGS

Certain preferred embodiments of the present invention will hereinafter be described in detail, by way of example only, with reference to the accompanying drawings, in which.

DESCRIPTION OF EMBODIMENTS

Embodiments of the present invention will hereinafter be described in detail with reference to the accompanying drawings.

Figure 1:
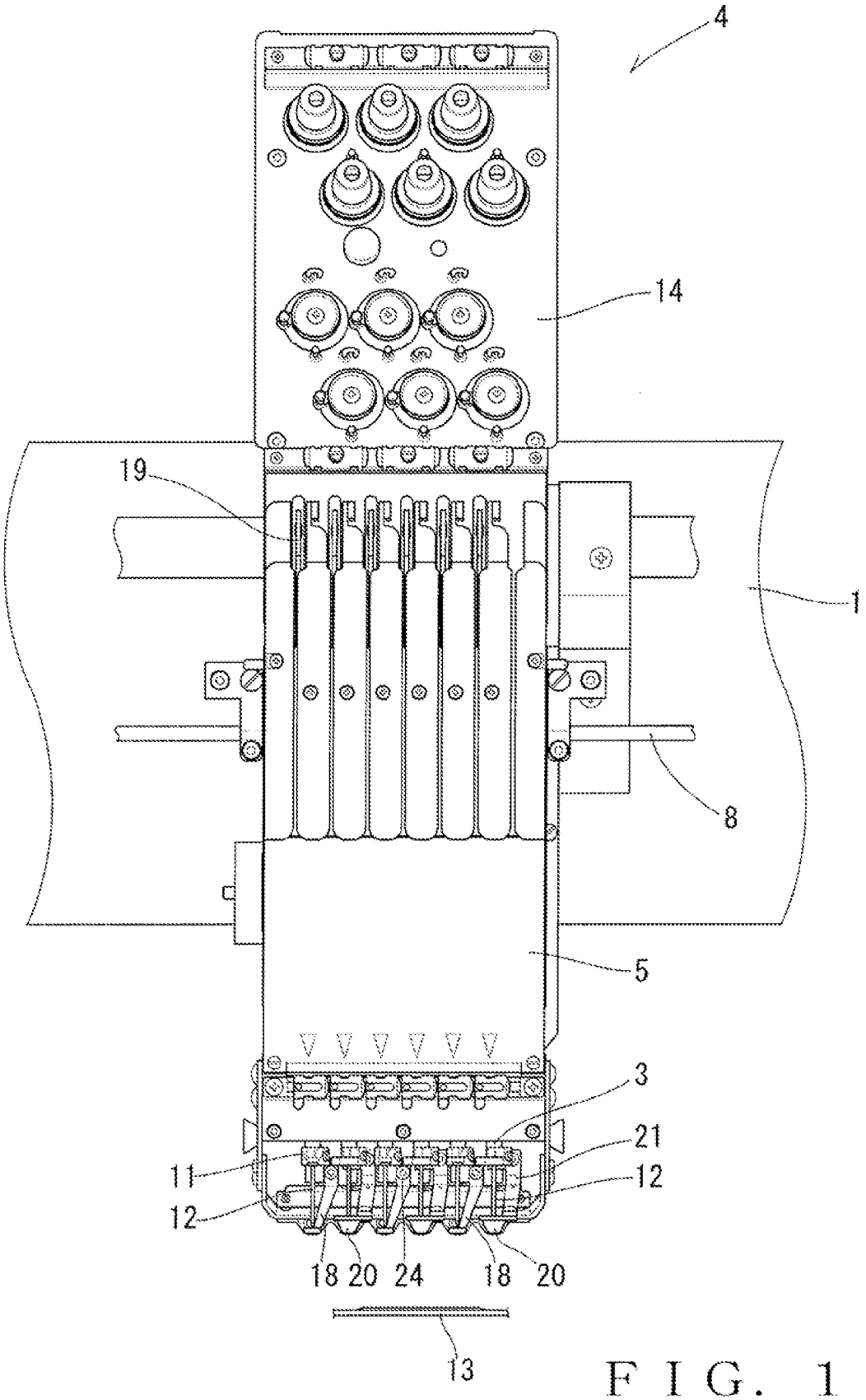
FIG. 1 is a front view showing an embroidery head of a multi-head embroidery sewing machine according to an embodiment of the present invention.

FIG. 1 is a front view of one of embroidery heads 4 of a multi-head embroidery sewing machine according to an embodiment of the present invention. A needle bar case 5 is supported on the front surface of a machine arm 2, which is in turn mounted to the front surface of a body frame 1, in such a manner that the needle bar case 5 is slidable in a left-right direction. A plurality of needle bars (six needle bars in the illustrated example) 3 are supported on the needle bar case 5 in such a manner that they are movable in an up-down direction. Each of the needle bars 3 is disposed in such a manner that its axis extends in a vertical or up-down direction, and a sewing needle 12 is mounted to the lower end of each of the needle bars 3 by means of a needle clamp 11.

Further, a slide shaft 8 extends through the needle bar case 5, so that the needle bar case 5 slides in the left-right direction by the slide shaft 8 being driven to slide by a motor. Any one of the needle bars 3 is positioned at an operating position in accordance with a sliding position of the needle bar case 5. In this way, any one of the needle bars 3 to be caused to operate or work is selected. A rotary hook of the conventionally-known structure (i.e., conventional rotary hook) is disposed under the needle bar 3 positioned at the operating position. The rotary hook is provided under a machine table 10, and a region located immediately above the rotary hook is covered with a needle plate 13. The needle plate 13 has a needle hole through which the sewing needle 12 of the selected needle bar 3 can pass.

Further, a main shaft 6 extends through the machine arm 2, so that, as the main shaft 6 is rotated by a main shaft motor (first drive source) 60 (see FIG. 3), a needle bar drive member 7 (see FIG. 3) is moved in the up-down direction by the rotation of the main shaft 6 via a not-shown cam mechanism etc. provided in the machine arm 2. The needle bar 3 selectively positioned at the operating position is caught by the needle bar drive member 7 and axially moved in the up-down direction (i.e., moved up and down) by the up-and-down movement of the needle bar drive member 7. A sewing operation of the embroidery sewing machine is performed in the well-known manner by the up-and-down movement of the needle bar 3 selectively positioned at the operating position (more specifically, the sewing needle 12 at the distal end of the needle bar 3).

Figure 3:
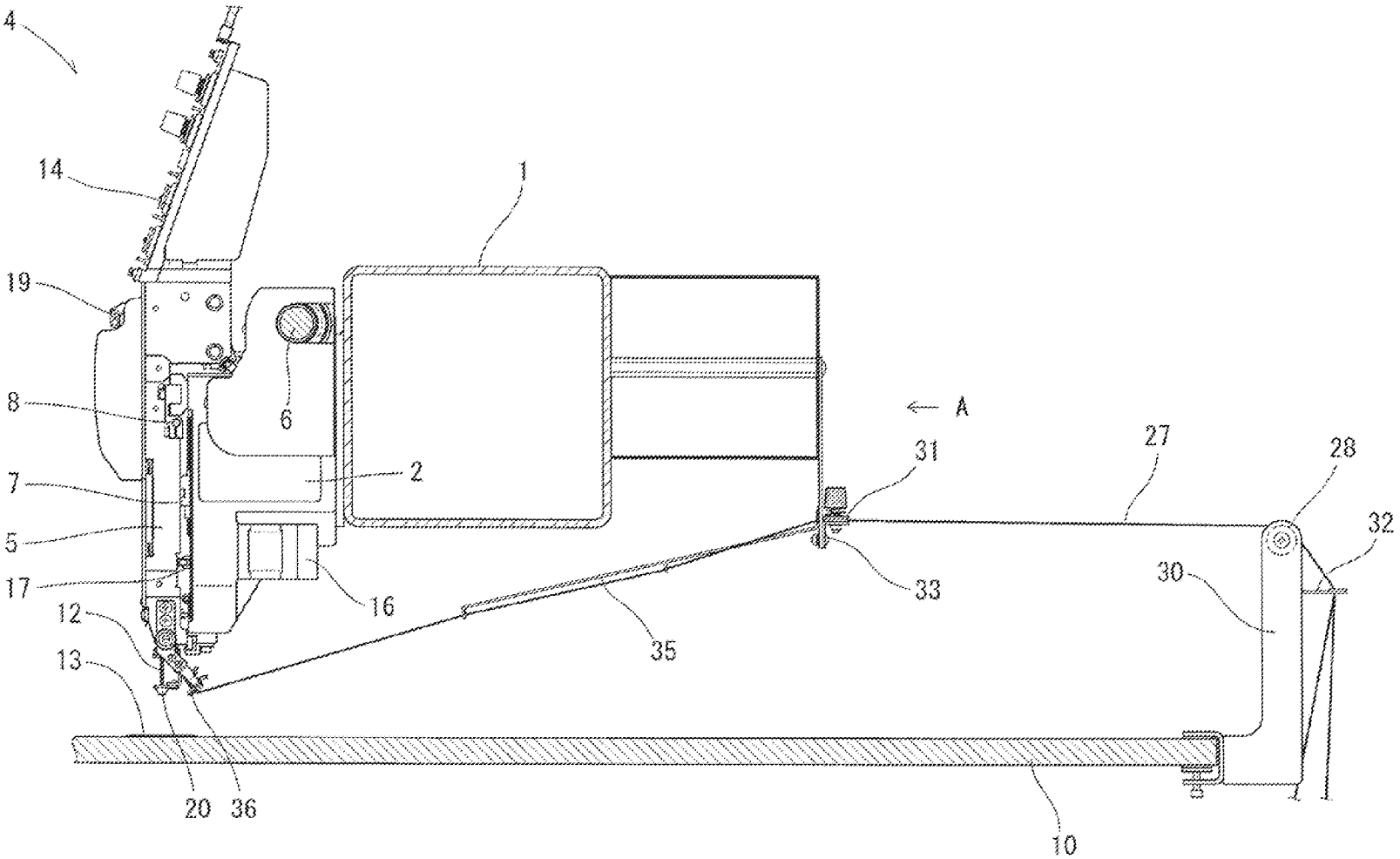
FIG. 3 is a vertical sectional view of a part of the embroidery sewing machine shown in FIG. 1.
Figure 4:
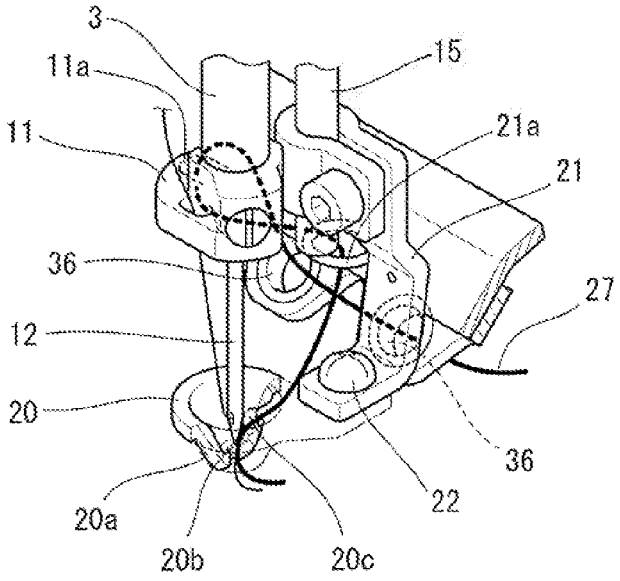
FIG. 4 is an enlarged perspective view of a needle bar and other elements around the needle bar shown in FIG. 1.
Figure 5:
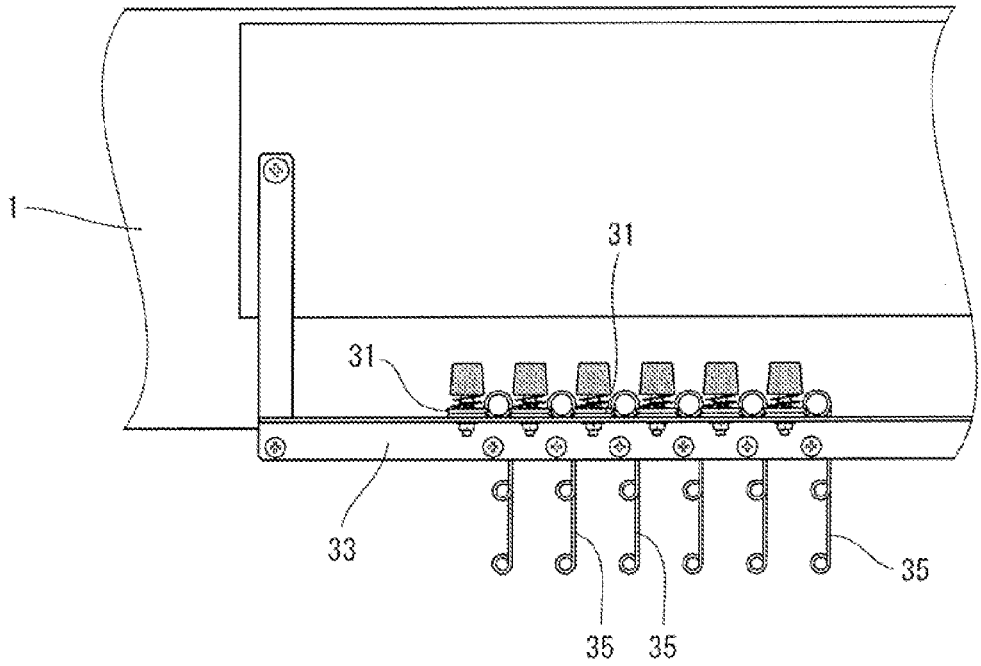
FIG. 5 is a view taken in a direction of arrow A of FIG. 3.
Figure 6:
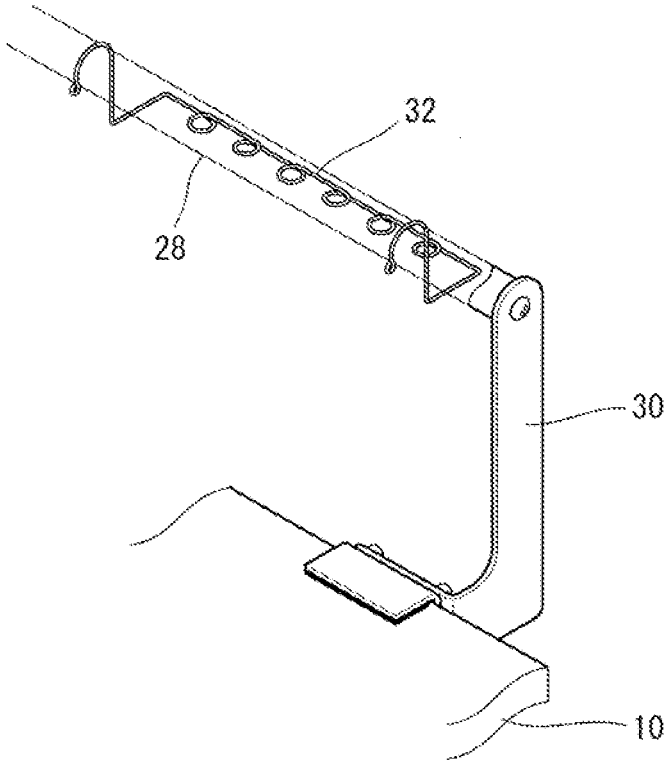
FIG. 6 is a perspective view showing a part of a cord material feed path in the embroidery sewing machine shown in FIG. 1.

Further, as shown in FIG. 4, ascending/descending bars 15 (ascending/descending members) are provided in corresponding relation to the needle bars 3, and each of ascending/descending bars 15 is supported on the needle bar case 5 behind the corresponding needle bar 3. Like the needle bar 3, the ascending/descending bar 15 is disposed in such a manner that its axis extends in the up-down (vertical) direction. As shown in FIG. 3, the ascending/descending bar 15 is driven by a motor 16 (second drive source) provided on the machine arm 2. Namely, a not-shown link mechanism is connected to the motor 16, so that, as the motor 16 is driven to reciprocatively rotate, a presser foot drive member 17 vertically movably supported on the machine arm 2 moves up and down. Further, of the ascending/descending bars 15 provided in the needle bar case 5, the ascending/descending bar 15 corresponding to the needle bar 3 selectively positioned at the operating position is caught by the presser foot drive member 17 and driven to move in the up-down direction (i.e., move up and down) by the up-and-down movement of the presser foot drive member 17.

Presser feet (or fabric pressing members) 18 of the conventionally-known structure (i.e., conventional presser feet) or cord guide members 20 characterizing the present invention may be mounted or attached to the lower ends of the ascending/descending bars 15. Each of the presser feet 18 is used for performing ordinary embroidery sewing, while each of the cord guide members 20 is used for guiding a cord material 27 onto a sewing workpiece when the cord material 27 is to be sewn onto the sewing workpiece.

Further, as shown FIG. 4, each of the cord guide members 20 is detachably mounted, by means of a screw 22, to a mounting member 21 that is in turn mounted to a lower end portion of the ascending/descending bar 15. The cord guide member 20 includes a cup-shaped pressing section 20*a* disposed beneath the needle bar 3. The pressing section 20*a* has a lead-out hole 20*b* formed through its bottom portion for guiding the cord material 27 onto the sewing workpiece. The pressing section 20*a* also has a lead-in hole 20*c* formed in its rear wall portion for guiding the cord material 27 into the lead-out hole 20*b*. The lead-out hole 20*b* is also a hole through which the sewing needle passes during sewing of the cord material 27.

On the other hand, the conventional presser foot 18 is, as shown in FIG. 1, is detachably mounted, by means of a screw 24, to a mounting member (not shown) that is in turn mounted to a lower end portion of the ascending/descending 15. The mounting member for mounting the presser foot 18 to the ascending/descending 15 is slightly different in shape from the above-mentioned mounting member 21 for mounting the cord guide member 20 to the ascending/descending 15.

Namely, the embroidery sewing machine according to the instant embodiment is constructed in such a manner that the cord guide member 20 is mounted to any of the ascending/descending bars 15 that corresponds to a given needle bar 3 to be used for sewing of the chord material 27, instead of the presser feet 18 being attached to all of the ascending/descending bars 15 provided in the needle bar case 5.

Further, as shown in FIG. 1, an adjusting table 14 for imparting a predetermined tension to a needle thread (upper thread) is disposed above the needle bar case 5. Further, thread take-up levers 19, identical in number to the needle bars 3 and constructed in the conventionally-known manner, are pivotably supported on the needle bar case 5.

Figure 2:
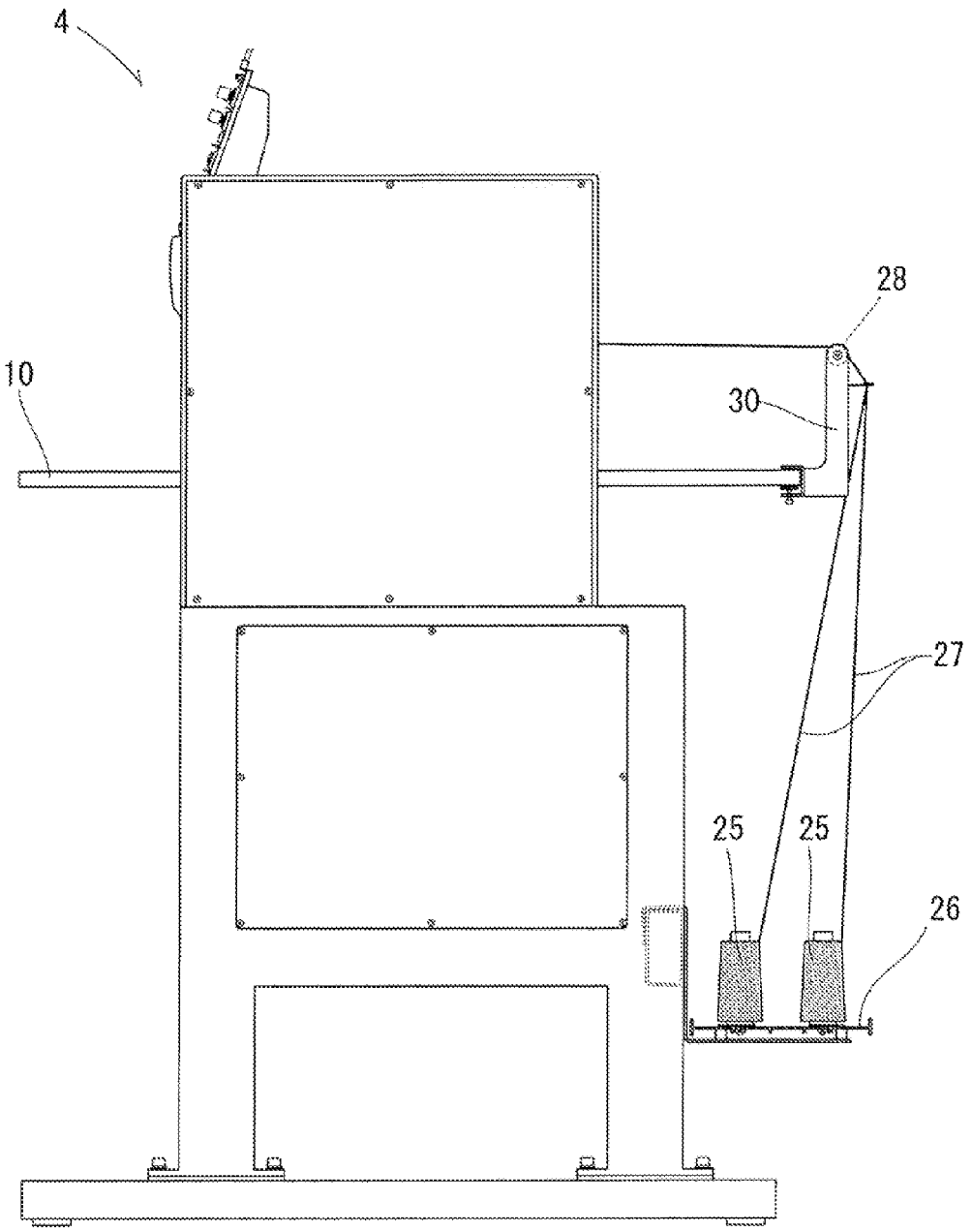
FIG. 2 is a right side view of the embroidery sewing machine shown in FIG. 1.

The following describe a feed path for feeding the cord material 27 in the embroidery sewing machine. As shown in FIG. 2, a support plate 26 for supporting thereon thread bobbins 25, each having the cord material 27 wound thereon, extends between the rear surfaces of left and right legs of the body of the embroidery sewing machine. One or more thread bobbins 25 are supported on the support plate 26. A deflecting bar 28 for deflecting the cord material 27 paid out and pulled upward from each of the thread bobbins 25 is supported by a stay 30 that is in turn fixed to the machine table 10.

Further, as shown in FIG. 3, an aligning member 32 for preventing overlapping contact among the cord materials 27 paid out from the thread bobbins 25 is mounted to the deflecting bar 28. The aligning member 32 is formed by bending a wire rod of stainless steel or the like. Further, on each of the embroidery heads 4, a plurality of thread tension disks 31 are supported, in front of the deflecting bar 28, by a stay 33 mounted to a housing fixed to the rear surface of the body frame 1. The thread tension disks 31 each serve to impart tension to the cord material 27. A hanging member 35 is fixed to the stay 33 near each of the thread tension disks 31. Each of the hanging members 35 has loop portions formed its distal end and its middle portion for passage therethrough of the cord material 27. For each of the needle bars 3, a guide hole 36 for passage therethrough of the cord material 27 is formed in a lower end portion of the needle bar 5 in corresponding relation to the rear of the needle bar 3.

The following describe an operational sequence for feeding the cord material 27 to a sewing position at the time of sewing of the cord material 27. A human operator passes from below the cord material 27, paid out from the thread bobbin 25 on the support plate 26, through the aligning member 32 located above the thread bobbin 25, then engages the cord material 27 with an outer surface portion of the deflecting bar 28, then passes the cord material 27 through the tension disk 31 located in front of the deflecting bar 28, then passes the cord material 27 through the loop portions formed on the hanging member 35, and then passes the cord material 27 through the guide hole 36 corresponding to the needle bar 3 to be used for sewing the cord material 27.

After passing the cord material 27 through the guide hole 36 as above, the human operator passes from above the cord material 27 through a thread hole 11*a* formed in the needle clamper 11 of the needle bar 3 corresponding to the guide hole 36 and then passes the cord material 27 through a thread guide 21*a* provided on the mounting member 21 of the ascending/descending bar 15 corresponding to the needle bar 3, as shown in FIG. 4. After that, the human operator directs the cord material 27, passed through the thread guide 21*a*, into the cup-shaped pressing section 20*a* through the lead-in hole 20*c* of the cord guide member 20 and then pulls the cord material 27 out of the pressing section 20*a* through the lead-out hole 20*b* formed in the bottom portion of the cup-shaped pressing section 20*a*. In the aforementioned manner, the cord material 27 is guided to a position beneath the needle bar 3.

Figure 7:
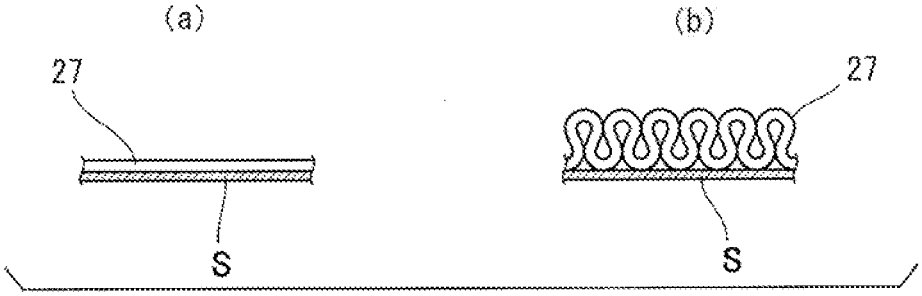
FIG. 7 is a view explanatory of manners in which the cord material is sewn in the embroidery sewing machine shown in FIG. 1, of which (a) is explanatory of cord sewing and (b) is explanatory of loop sewing.

The embroidery sewing machine according to the instant embodiment of the present invention is constructed in such a manner that, when the cord material 27 is to be sewn onto an embroidery sewing workpiece s (sewing workpiece), it can selectively perform the cord sewing and the loop sewing of the cord material 27 by merely changing an ascending/descending stroke of the corresponding ascending/descending bar 15. A part (a) of FIG. 7 shows a manner in which the "cord sewing" is performed to sew the cord material 27 onto the embroidery sewing workpiece as if adhering the cord material 27 onto and along the upper surface of the sewing workpiece s, and a part (b) of FIG. 7 shows a manner in which the "loop sewing" is performed to sew the cord material onto the embroidery sewing workpiece s in a loop configuration. Note that illustration of sewing threads (needle and bobbin threads) is omitted in the parts (a) and (b) of FIG. 7.

Figure 8:
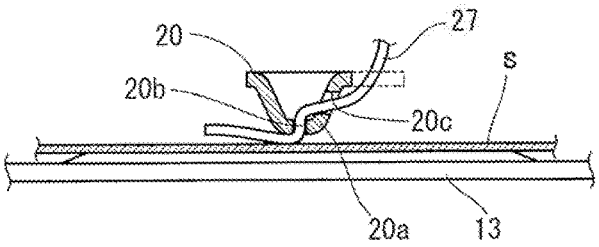
FIG. 8 is a view explanatory of the cord sewing.

In the cord sewing shown in the part (a) of FIG. 7, the cord guide member 20 is positioned at its bottom dead point, without being moved up and down (i.e., with the stroke length of the ascending/descending bar 15 kept zero), regardless of the sewing operation of the corresponding needle bar 3 (not shown in FIG. 8). With the cord guide member 20 positioned at its bottom dead point, the cord material 27 is pressed by the bottom surface of the pressing section 20*a* of the cord guide member 20 against the embroidery sewing workpiece s. Then, with the cord material 27 kept pressed by the bottom surface of the pressing section 20*a* against the embroidery sewing workpiece s, the cord sewing of the cord material 27 is progressed. In this manner, the cord material 27 is sewn onto the embroidery sewing workpiece s as if adhered onto and along the upper surface of the embroidery sewing workpiece s.

Figure 9:
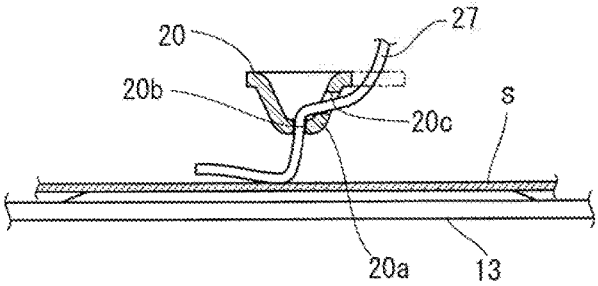
FIG. 9 is a view explanatory of the loop sewing.

In the loop sewing shown in the part (b) of FIG. 7, on the other hand, the loop sewing of the cord material 27 is progressed with the cord guide member 20 moved up and down in a stroke between the bottom dead point and a predetermined height position from the bottom dead point of the in synchronism with each sewing stroke of the corresponding needle bar 3 (not shown in FIG. 9), as shown in FIG. 9. Namely, with the cord guide member 20 positioned at its bottom dead point, the cord material 27 is pressed by the bottom surface of the pressing section 20*a* of the cord guide member 20 against the embroidery sewing workpiece s, and the cord material 27 is sewn onto the embroidery sewing workpiece s in such a pressed state by the sewing operation of the needle bar 3. After that, the cord guide member 20 ascends to the predetermined height position and then descends back to the bottom dead point, so that the cord material 27 is paid out by an extra length corresponding to the reciprocating (ascending/descending) stroke, through the predetermined height, of the cord guide member 20. A "loop" is formed by the extra paid-out length of the cord material 27. FIG. 9 shows a state where the cord guide member 20 has ascended to the predetermined height position. The cord material 27 is sewn onto the embroidery sewing workpiece s with the cord guide member 20 moved down back to the bottom dead point. The loop sewing shown in the part (b) of FIG. 7 is performed by repetition of such movement. Note that, whereas loops are shown in the part (b) of FIG. 7 as standing up on the embroidery sewing workpiece s, the part (b) of FIG. 7 is merely for the purpose of illustrating the concept of the loop sewing. As a matter of fact, the loops of the cord material 27 are pressed down (sewn down) by successive repetition of the loop sewing. Although the term "loop height" will be used in the specification to conceptually refer to a height of each loop standing on the embroidery sewing workpiece s as shown in the part (b) of FIG. 7, it actually corresponds to a length of one loop paid out onto the embroidery sewing workpiece s.

The height of the loop (loop height) corresponds to the stroke length of the cord guide member 20. Namely, as the stroke length of the cord guide member 20 is increased, the loop height increases in substantial proportion to the increase of the stroke length of the cord guide member 20. Thus, changing the stroke length of the cord guide member 20 can change the loop height.

Figure 10:
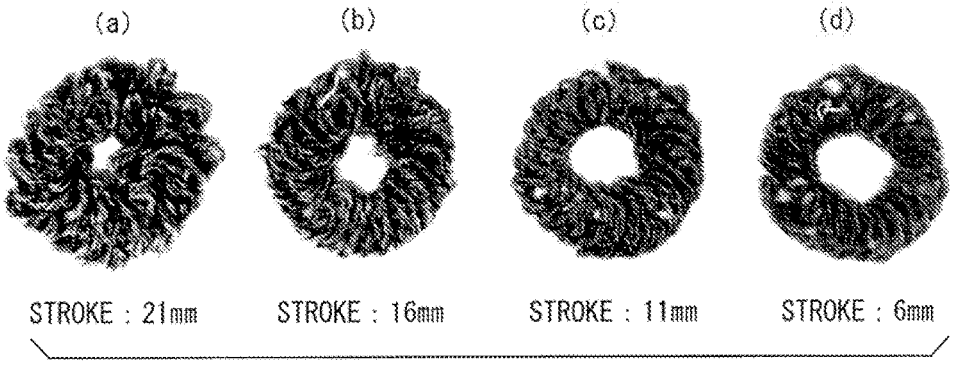
FIG. 10 shows some sample patterns of the loop sewing in part (a) to (d).

Further, FIG. 10 is a diagram explanatory of different sewing patterns corresponding to different loop heights. More specifically, FIG. 10 shows sample sewing patterns formed by loop-sewing the cord material 27 with the stroke length of the cord guide member 20 set at 6 mm (part (d) of FIG. 10), at 11 mm (part (c) of FIG. 10), at 15 mm (part (b) of FIG. 10) and at 21 mm (part (a) of FIG. 10), respectively. These sewing patterns are each formed by causing a running stitch of a predetermined stitch length to run in a spiral shape. As clearly seen from FIG. 10, as the stroke length of the cord guide member 20 is increased, the length of the cord material 27 paid out per sewing of one loop of the cord material 27 increases, and thus, the loop height increases. As the loop height increases like this, the sewn pattern becomes bulky so that a three-dimensional feel can be imparted.

The human operator can change the stroke length of the cord guide member 20 (i.e., the ascending/descending stroke of the ascending/descending 15) by merely changing a related setting via a not-shown operation panel. In accordance with the setting made via the not-shown operation panel, a not-shown control device controls a reciprocating driving amount of the motor 16 to thereby control the stroke length of the cord guide member 20. The stroke length of the cord guide member 20 can be set in appropriate units (e.g., 0.1 mm) within an appropriate stroke range (of, for example, 0 to 25 mm). The stroke length of the cord guide member 20 can be set in advance, for each of the needle bars 3 to be used for the sewing of the cord material 27. Also, the stroke length of the cord guide member 20 corresponding to the currently used needle bar 3 can be changed on the spot after the embroidery sewing machine is deactivated temporarily in the middle of the sewing.

Thus, the human operator can readily change the stroke length of the cord guide member 20 without performing any mechanical adjusting operation and thereby not only select between the cord sewing and the loop sewing but also change the loop height for the loop sewing. Further, because the selection between the cord sewing and the loop sewing can be realized by only the stroke length of the cord guide member 20 being changed through control of the motor 16, even the cord guide member 20 usable for both the cord sewing and the loop sewing can be simple in mechanical construction. In this way, it is possible to provide an improved embroider sewing machine which can selectively perform the cord sewing and the loop sewing of the cord material 27 with a simple construction.

With the embroider sewing machine according to the instant embodiment of the invention, where a separate cord guide member 20 is mounted to each of the ascending/descending bars 15 corresponding to the needle bars 3, the cord material 27 can be sewn by a desired one of the cord sewing or the loop sewing for each of the plurality of needle bars 3 provided in the single needle bar case 5. Assuming that the needle bars shown in FIG. 1 are, from right to left, needle bars 3*a*, 3*b*, 3*c*, 3*d*, 3*e* and 3*f*, the cord guide members 20 are mounted to three ascending/descending bars 15 corresponding to three needle bars 3*a*, 3*c* and 3*e*, while the presser feet 18 are mounted to the ascending/descending bars 15 corresponding to the other three needle bars 3*b*, 3*d* and 3*f*. In this case, three types of cord materials 27, differing from one another in material, color, thickness, etc., can be set for the three needle bars 3*a*, 3*c* and 3*e* and sewn by either the cord sewing or the loop sewing. Particularly, in the case where the cord material 27 is sewn by the loop sewing, it can be sewn with the loop height set at a desired value. If the cord guide members 20 are mounted to all of the ascending/descending bars 15 provided in the needle bar case 5, up to six types of cord materials 27, differing from one another in material, color, thickness, etc., can be sewn.

Note that, even with the cord guide member 20 attached to a given one of the ascending/descending bars 15, it is also possible to perform ordinary embroidery sewing by use of the needle bar 3 corresponding to the given ascending/descending bar 15. In such a case, by the embroidery sewing workpiece s being pressed by the bottom surface of the pressing section 20*a*, the cord guide member 20 can function similarly to the presser foot 18. Thus, when only the cord sewing or the loop sewing of the cord material 27 is to be performed, the ordinary embroidery sewing can be performed with no problem even where the cord guide members 20 are attached in corresponding relation to all of the needle bars 3. Note, however, that, with the construction where the cord guide members 20 are used also as the presser feet, some problem might be encountered depending on the thickness of the embroidery sewing workpiece or manner or style of the embroidery. In such a case, the cord guide member 20 corresponding to the needle bar 3 that is used for performing the ordinary embroidery sewing may be replaced with the ordinary presser foot 18.

The present invention should not be construed as limited to the above-described embodiment alone and may be modified variously within the scope of the technical idea described in the claims, description and drawings. For example, the construction for mounting the cord guide member 20 to the ascending/descending bar 15 is not limited to the one employed in the above-described embodiment. Further, the ascending/descending bar 15 is not limited to a bar shape as long as it is an ascending/descending member ascendable and descendable in its axial direction.

What is claimed is:

1. An embroidery sewing machine comprising:

a needle bar case having a plurality of needle bars accommodated therein in a horizontal arrangement, a sewing needle being attachable to each of the plurality of needle bars, the needle bar case further having accommodated therein a plurality of ascending/descending members provided behind and in corresponding relation to the plurality of needle bars, the needle bar case being slidable horizontally to selectively position any selected one of the plurality of needle bars and a corresponding one of the plurality of ascending/descending members at a predetermined operating position;

a first drive source for engaging and driving the selected one needle bar, positioned at the operating position, in an up-down direction;

a second drive source for engaging and driving the corresponding one ascending/descending member, positioned at the operating position, in the up-down direction;

a plurality of cord guide members mounted to lower ends of respective ones of the plurality of ascending/descending members, each of the plurality of cord guide members including a pressing section for pressing a sewing workpiece, and a lead-out hole provided, in a bottom portion of the pressing section, for permitting passage therethrough of the sewing needle and for guiding a cord material onto a sewing workpiece; and a plurality of cord material feed paths constructed to guide cord materials, paid out from separate cord supply sources, to respective ones of the plurality of cord guide members.

2. The embroidery sewing machine as claimed in claim 1, wherein a first cord guide member among the plurality of cord guide members is detachably mounted to a respective ascending/descending member among the plurality of ascending/descending members, and the respective ascending/descending member is configured to allow one of the first cord guide member and a presser foot to be detachably mounted thereto in such a manner that the one of the first cord guide member and the presser foot detachably mounted to the respective ascending/descending member is replaceable with the other one of the first cord guide member and the presser foot.

3. The embroidery sewing machine as claimed in claim 1, which is configured to change a style of sewing of the cord material, having been guided by a cord guide member among the plurality of cord guide members, by changing an ascending/descending stroke length of a respective ascending/descending member among the plurality of ascending/descending members via the second drive source.

4. The embroidery sewing machine as claimed in claim 3, which, in a case where the ascending/descending stroke length of the respective ascending/descending member is set at zero, the cord material is sewn onto the sewing workpiece as if adhering the cord material onto and along an upper surface of the sewing workpiece, and which, in a case where the respective ascending/descending member is moved up and down with the ascending/descending stroke length set greater than zero, the cord material is sewn onto the sewing workpiece in a loop configuration.

5. The embroidery sewing machine as claimed in claim 3, which is configured to allow the style of sewing of the cord material to be changed in a middle of sewing of a sewing pattern by changing the ascending/descending stroke length of the respective ascending/descending member in the middle of the sewing of the sewing pattern.

6. The embroidery sewing machine as claimed in claim 1, wherein each of the plurality of cord guide members further includes:

a lead-in hole for guiding the cord material to the lead-out hole.

7. The embroidery sewing machine as claimed in claim 1, wherein the plurality of needle bars includes three or more needle bars, the plurality of ascending/descending members includes three or more ascending/descending members, and the plurality of cord guide members includes three or more cord guide members.

* * * * *